US011421705B2

(12) United States Patent
Niwa et al.

(10) Patent No.: US 11,421,705 B2
(45) Date of Patent: Aug. 23, 2022

(54) COMPRESSOR HOUSING FOR TURBOCHARGER AND METHOD FOR MANUFACTURING THE SAME

(71) Applicant: OTICS CORPORATION, Nishio (JP)

(72) Inventors: Tetsuya Niwa, Aichi (JP); Tomoyuki Isogai, Aichi (JP)

(73) Assignee: OTICS CORPORATION, Nishio (JP)

( * ) Notice: Subject to any disclaimer, the term of this patent is extended or adjusted under 35 U.S.C. 154(b) by 0 days.

(21) Appl. No.: 17/063,805

(22) Filed: Oct. 6, 2020

(65) Prior Publication Data

US 2021/0215169 A1 Jul. 15, 2021

(30) Foreign Application Priority Data

Jan. 9, 2020 (JP) ..... JP2020-001855

(51) Int. Cl.

| | |
|---|---|
| ***F04D 29/42*** | (2006.01) |
| ***F04D 29/62*** | (2006.01) |
| *F04D 29/44* | (2006.01) |
| *F04D 29/28* | (2006.01) |
| *F02B 37/00* | (2006.01) |
| *F04D 29/58* | (2006.01) |

(52) U.S. Cl.

CPC ..... *F04D 29/4206* (2013.01); *F04D 29/624* (2013.01); *F02B 37/00* (2013.01); *F04D 29/284* (2013.01); *F04D 29/441* (2013.01); *F04D 29/584* (2013.01); *F05D 2220/40* (2013.01); *F05D 2230/21* (2013.01); *F05D 2300/43* (2013.01)

(58) Field of Classification Search

CPC ..... Y10T 29/49876; Y10T 29/49945; Y10T 29/49936; B23P 11/02; B23P 19/02; F02B 37/00; F04D 29/023; F04D 29/083; F04D 29/284; F04D 29/4206; F04D 29/441; F04D 29/584; F04D 29/624; F05D 2220/40; F05D 2230/21; F05D 2300/43; F05D 2260/37

See application file for complete search history.

(56) References Cited

U.S. PATENT DOCUMENTS

| | | | | |
|---|---|---|---|---|
| 4,425,699 | A * | 1/1984 | Nordin | B21K 25/00 277/399 |
| 8,820,072 | B2 * | 9/2014 | Figura | F04D 29/5853 60/605.1 |
| 10,436,216 | B2 | 10/2019 | Uesugi et al. | |
| 10,982,687 | B2 * | 4/2021 | Niwa | F01D 25/24 |

(Continued)

FOREIGN PATENT DOCUMENTS

JP 2016-176353 A 10/2016

*Primary Examiner* — Jesse S Bogue

(74) *Attorney, Agent, or Firm* — Oliff PLC

(57) ABSTRACT

A compressor housing for a turbocharger dividably composed of a plurality of pieces including a scroll piece and a shroud piece. The scroll piece and the shroud piece are assembled to each other by press-fitting a press-fitting portion of the shroud piece into a press-fitted portion of the scroll piece in an axial direction. A pressure-contacting portion provided on either one of the scroll piece and the shroud piece is pressure-contacted with a pressure-contacted portion provided on the other one of the scroll piece and the shroud piece in the axial direction to thereby cause plastic flow to both portions, so that a plastic flow portion is annularly formed. Thus, the scroll piece and the shroud piece are sealed to each other.

12 Claims, 16 Drawing Sheets

(56) References Cited

U.S. PATENT DOCUMENTS

| | | | | |
|---|---|---|---|---|
| 11,035,377 | B2 * | 6/2021 | Niwa | F04D 29/441 |
| 2005/0067831 | A1 * | 3/2005 | Tokairin | B21D 39/04 285/3 |
| 2011/0147624 | A1 * | 6/2011 | Schepp | B60T 8/363 251/65 |
| 2011/0217162 | A1 * | 9/2011 | Dillon | F04D 29/624 415/207 |
| 2013/0039750 | A1 * | 2/2013 | Osuka | F04D 29/4206 415/204 |
| 2014/0234494 | A1 * | 8/2014 | Doglioni Majer | A47J 31/369 426/115 |
| 2016/0273548 | A1 | 9/2016 | Uesugi et al. | |
| 2018/0252229 | A1 * | 9/2018 | Isogai | F04D 29/441 |
| 2018/0313361 | A1 * | 11/2018 | Niwa | F01D 9/026 |
| 2020/0263701 | A1 * | 8/2020 | Isogai | F04D 29/624 |
| 2020/0325902 | A1 * | 10/2020 | Isogai | F04D 17/10 |

* cited by examiner

COMPRESSOR HOUSING FOR TURBOCHARGER AND METHOD FOR MANUFACTURING THE SAME

CROSS-REFERENCE TO RELATED APPLICATION

The present application claims priority under 35 U.S.C. § 119 to Japanese Application No. 2020-001855, filed on Jan. 9, 2020, entitled "COMPRESSOR HOUSING FOR TURBOCHARGER AND METHOD FOR MANUFACTURING THE SAME". The contents of the application are incorporated herein by reference in its entirety.

BACKGROUND OF THE INVENTION

Field of the Invention

The present disclosure relates to a compressor housing for a turbocharger and a method for manufacturing the same.

Description of the Related Art

A turbocharger to be mounted on an internal combustion engine of an automobile, etc. includes a compressor impeller and a turbine impeller, which are housed in a housing. The compressor impeller is disposed in an air flow path that is formed inside a compressor housing. The air flow path is provided with an intake port for sucking in air toward the compressor impeller, a diffuser passage which pressurizes air discharged from the compressor impeller passes, and a discharge scroll chamber into which compressed air having passing through the diffuser passage flows. The discharge scroll chamber discharges the compressed air into the internal combustion engine side.

Some internal combustion engines for an automobile, etc. are provided with a positive crankcase ventilation system (hereinafter referred to as PCV) for purifying the inside of a crankcase and/or the inside of a head cover by reflowing blowby gas that has generated in the crankcase in an intake passage. In such a configuration, oil (oil mist) contained in the blowby gas may flow out from the PCV into the intake passage that is located upstream of the compressor in the turbocharger under some circumstances.

In that case, if air pressure at an outlet port of the compressor is high, air temperature there is made high, so that in some cases, the oil flowing out from the PCV is concentrated and thickened to have high viscosity due to evaporation, and is accumulated as deposit on, for example, a diffuser surface of a compressor housing for a turbocharger and/or the surface of a bearing housing which opposes the diffuser surface. And, there is a risk that the deposit thus accumulated may narrow the diffuser passage to thereby cause reduction in performance of the turbocharger and reduction in output of the internal combustion engine.

In the past, an air temperature at the outlet port of the compressor was controlled to some extent to prevent such deposit accumulation in the diffuser passage as described above. As a result, a turbocharger was not able to satisfactorily exhibit its performance, and the output of an internal combustion engine was not satisfactorily raised.

Patent Document 1 discloses a configuration to prevent deposit accumulation in a diffuser passage, in which a refrigerant flow path is provided inside a compressor housing for a turbocharger to allow a refrigerant to pass therethrough, thereby restraining an increase in the temperature of compressed air passing through an air flow path inside the housing. In the configuration disclosed in Patent Document 1, the housing for a turbocharger is formed of a first piece and a second piece, and a third piece, and these pieces are assembled with each other to define a refrigerant flow path.

PRIOR ART LITERATURE

Patent Document

Patent Document 1
JP-A-2016-176353

SUMMARY OF THE INVENTION

However, in the configuration disclosed in Patent Document 1, it is necessary to form a holding part for holding an O-ring serving as a sealing member between the first piece and the second piece for the purpose of keeping the liquid-tightness in the refrigerant flow path, to fit the sealing member in the holding part, and further to clip the O-ring with the first piece and the second piece. For this reason, increase in cost due to increase in the number of parts, and deterioration in assembling workability are caused.

Instead, to restrain cost increase and achieve an improvement in workability, it may be considered to form a seal part without using the O-ring as a sealing member, by press-fitting a shroud piece into a scroll piece in the axial direction so as to cause plastic flow at pressure-contacting portions of both pieces that are press-contacted with each other. In such a configuration, in order to ensure reliability of sealing performance at the seal part, it is necessary to secure a sufficient amount of plastic flow, and the portions at which plastic flow is caused is required to have high supporting rigidity. However, because the sizes and dimensions of a scroll chamber and a compressor impeller have a limitation to secure the intake-air amount and a production amount of compressed air, it is difficult in some cases to secure a sufficient wall thickness in the radial direction at the seal part of the refrigerant flow path. This tendency is remarkable particularly in a compact turbocharger. Therefore, it is difficult to secure a sufficient sealability while keeping the size of the compressor housing unchanged, and an improvement in the sealability of the seal part is required.

It is noted that also in the case where a compressor housing for a turbocharger having no refrigerant flow path is dividably formed of a scroll piece and a shroud piece, and both pieces are assembled together by press-fitting, the improvement in sealability at a press-fitting part between both pieces is required in some cases. Also in this case, there exists the problems as mentioned above.

The present disclosure has been made in view of such problems, and is directed to a compressor housing for a turbocharger in which an improvement in sealability can be achieved compatibly with cost reduction.

One aspect of the present disclosure provides a compressor housing for a turbocharger configured to house a compressor impeller, the compressor housing including:

an intake port configured to suck in air toward the compressor impeller;

a shroud part having a shroud surface that surrounds the compressor impeller in a circumferential direction;

a diffuser part that is formed on an outer circumferential side of the compressor impeller in the circumferential direction and is configured to pressurize air discharged from the compressor impeller; and a scroll chamber configured to guide compressed air having passed through the diffuser part to outside; wherein the compressor housing is dividably composed of a plurality of pieces including a scroll piece having at least the intake port and a portion of the scroll chamber, and a shroud piece having at least a portion of the scroll chamber, a portion of the diffuser part, and the shroud part, the scroll piece and the shroud piece are assembled to each other by press-fitting a press-fitting portion of the shroud piece into a press-fitted portion of the scroll piece in an axial direction, and the scroll piece and the shroud piece are sealed to each other by annularly forming a plastic flow portion that is formed by plastic flow caused to a pressure-contacting portion and a pressure-contacted portion by pressure-contacting the pressure-contacting portion that is provided on either one of the scroll piece and the shroud piece with the pressure-contacted portion that is provided on the other one of the scroll piece and the shroud piece in the axial direction.

In the compressor housing for a turbocharger according to the above-mentioned aspect, because the plastic flow portion annularly formed between the scroll piece and the shroud piece is formed by plastic flow caused by pressure-contacting the pressure-contacting portion that is provided on either one of the scroll piece and the shroud piece with the pressure-contacted portion that is provided on the other one of the scroll piece and the shroud piece, a micro-order gap can be filled and high sealability can be achieved. Further, because the pressure-contacted portion and the pressure-contacting portion are pressure-contacted in the axial direction at the plastic flow portion, it is possible to achieve an improvement in sealability of the plastic flow portion, even in the case where it is difficult to secure a sufficient wall thickness in the radial direction, by increasing the supporting rigidity at the plastic flow portion while keeping the shape of the scroll chamber formed outside of the diffuser part in the radial direction unchanged. In addition, because there is no need to use any separate components such as an O-ring for the purpose of sealing the refrigerant flow path, cost reduction can be achieved.

As mentioned above, according to this aspect, the compressor housing for a turbocharger in which an improvement in sealability is achieved compatibly with cost reduction can be provided.

DETAILED DESCRIPTION OF THE INVENTION

Figure 1:
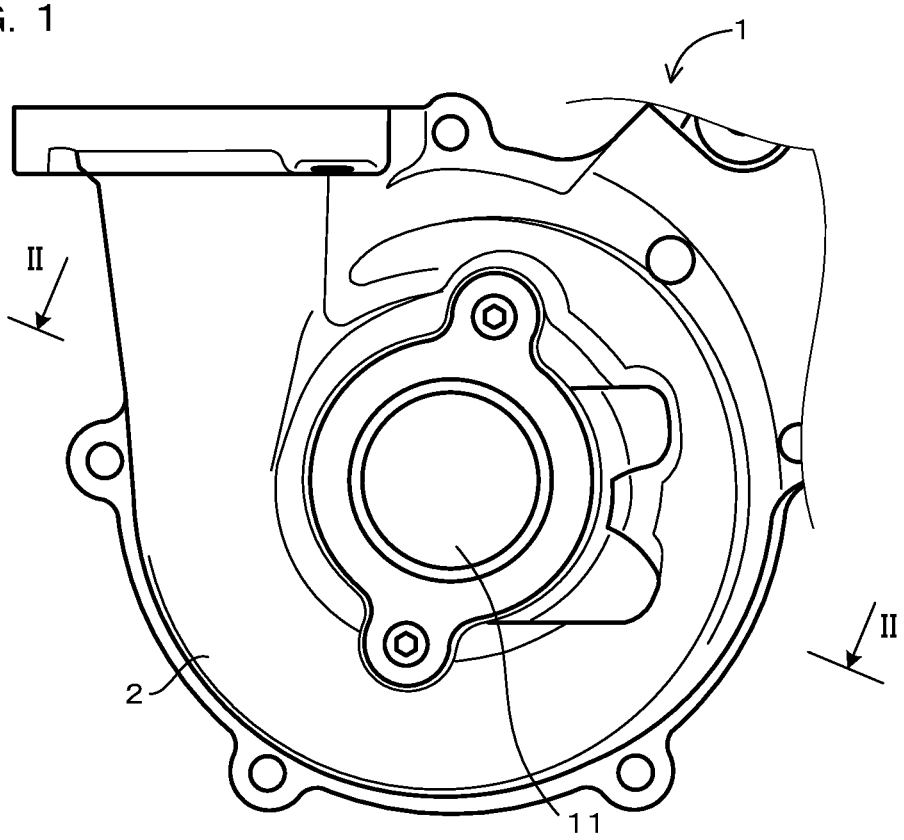
FIG. 1 is a top view of a compressor housing for a turbocharger in accordance with Embodiment 1.

In the present specification, "circumferential direction" means the rotation direction of a compressor impeller, "axial direction" means the direction of a rotation shaft of the compressor impeller, "radial direction" means the radius direction of an imaginary circle centered on the rotation shaft of the compressor impeller, and "outside in the radial direction" means the direction straightly extending from the center of the imaginary circle to the circumference of the circle.

The scroll piece and the shroud piece each preferably have a contact surface at the different position from the positions of the pressure-contacting portion and the pressure-contacted portion, the contact surface of the scroll piece and the contact surface of the shroud piece being in contact with each other in the axial direction to thereby define the press-fitting position of the press-fitting portion. In this case, the plastic flow portion is formed in the state in which the shroud piece is press-fitted into the prescribed press-fitting position with respect to the scroll piece, and thus the prescribed plastic flow amount is secured to thereby achieve an improvement in sealability.

The compressor housing for a turbocharger preferably includes a refrigerant flow path that is formed in the circumferential direction along the diffuser part, and allows a refrigerant for cooling the diffuser part to pass therethrough, wherein the refrigerant flow path is formed as an annular space that is constituted by a first refrigerant flow-path formation part of the scroll piece and a second refrigerant flow-path formation part of the shroud piece, the first refrigerant flow-path formation part and the second refrigerant flow-path formation part being formed respectively at each opposing part of the scroll piece and the shroud piece which oppose each other, an annular inner circumferential seal part is formed by press-fitting the press-fitting portion into the press-fitted portion on the inner circumferential side of the refrigerant flow path, an annular outer circumferential seal part composed of the plastic flow portion is formed on the outer circumferential side of the refrigerant flow path, and the refrigerant flow path is sealed by the inner circumferential seal part and the outer circumferential seal part.

According to such a configuration, because the compressor housing for a turbocharger having the refrigerant flow path provided therein has no need to increase the supporting rigidity in the radial direction even on the outer circumferential side of the refrigerant flow path, which includes a portion hardly ensuring a sufficient wall thickness, an improvement in sealability of the refrigerant flow path can be achieved compatibly with cost reduction while keeping the shape of the scroll chamber unchanged.

Another aspect of the present disclosure provides a method for manufacturing the compressor housing for a turbocharger, the method including:

molding the scroll piece and the shroud piece by die-casting;

machining the scroll piece and the shroud piece to form either one of the pressure-contacting portion and the pressure-contacted portion and the other one of the pressure-contacting portion and the pressure-contacted portion respectively; and assembling the scroll piece and the shroud piece to each other by press-fitting the press-fitting portion into the press-fitted portion while pressure-contacting the pressure-contacting portion with the pressure-contacted portion in the axial direction to cause plastic flow thereto and form the plastic flow portion.

According to this configuration, the above-mentioned compressor housing for a turbocharger can be manufactured. Further, because the pressure-contacted portion and the pressure-contacting portion are formed by machining in the machining step, the surfaces thereof can be made rough to some extent in comparison with a cast surface made by die-casting, which makes it possible to easily cause plastic flow to the pressure-contacting portion and the pressure-contacted portion during the assembling step, so that the sealability of the plastic flow portion can be enhanced.

In the above-mentioned machining, the pressure-contacting portion is preferably formed on a ridgeline portion that projects convexly to the pressure-contacted portion. In this case, the pressure-contacting portion is allowed to plastically flow with ease when the pressure-contacting portion is pressure-contacted to the pressure-contacted portion, so that the plastic flow portion is easily formed.

EMBODIMENTS

Embodiment 1

Hereinafter, embodiments of the above-mentioned compressor housing for a turbocharger will be described with reference to FIGS. 1 to 9.

Figure 2:
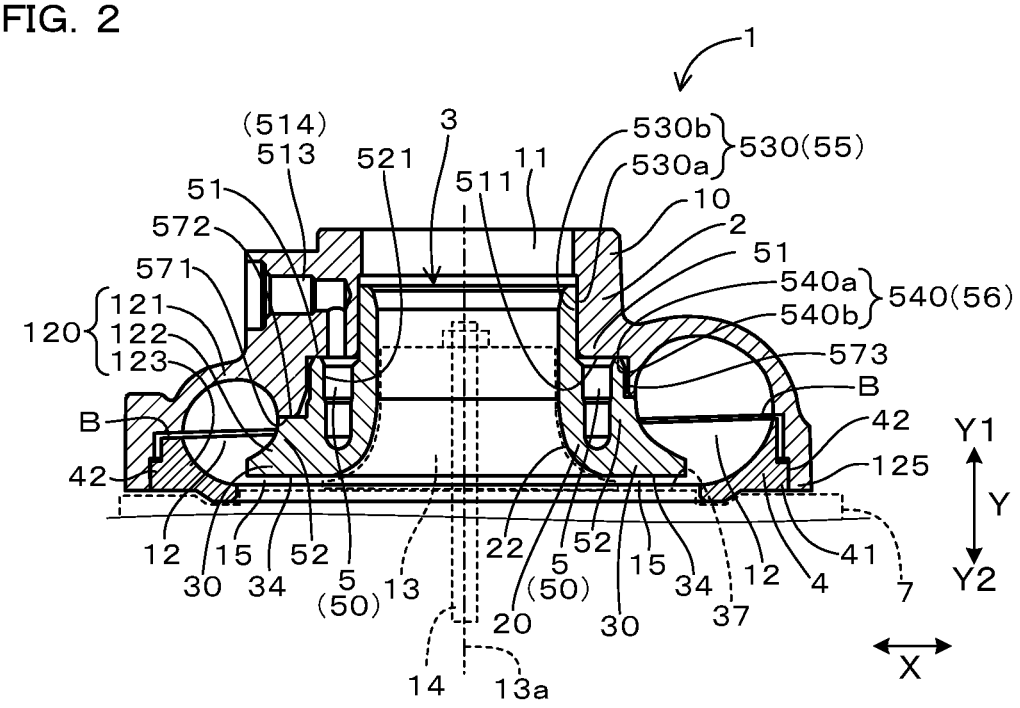
FIG. 2 is a cross-sectional view taken along line II-II of FIG. 1.

As shown in FIG. 2, a compressor housing 1 for a turbocharger has a compressor impeller 13 housed therein, and is provided with an intake port 11, a shroud part 20, a diffuser part 30, and a scroll chamber 12.

The intake port 11 is configured to suck in air toward the compressor impeller 13.

The shroud part 20 surrounds the compressor impeller 13 in the circumferential direction and has a shroud surface 22 facing the compressor impeller 13.

The diffuser part 30 is formed on the outer circumferential side of the compressor impeller 13 in the circumferential direction to pressurize air discharged from the compressor impeller 13.

The scroll chamber formation part 12 is formed outside of the diffuser part 30 in the radial direction to guide compressed air passing through the diffuser passage 15 to outside.

And the compressor housing 1 is dividably composed of a plurality of pieces including the scroll piece 2 and the shroud piece 3.

The scroll piece 2 has at least the intake port 11 and a portion of the scroll chamber 12.

The shroud piece 3 has at least a portion of the scroll chamber 12, a portion of the diffuser part 30, and the shroud part 20.

Figure 3:
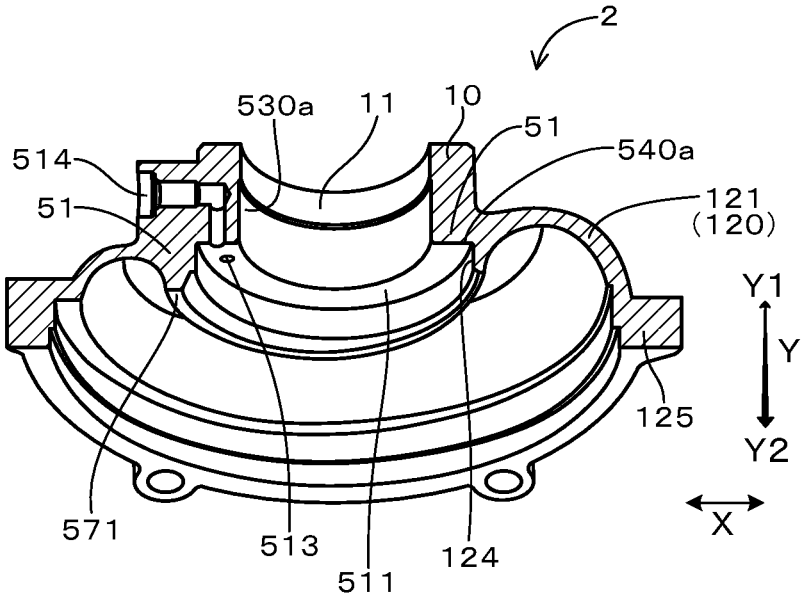
FIG. 3 is a perspective, cross-sectional view of a scroll piece in accordance with Embodiment 1.
Figure 5:
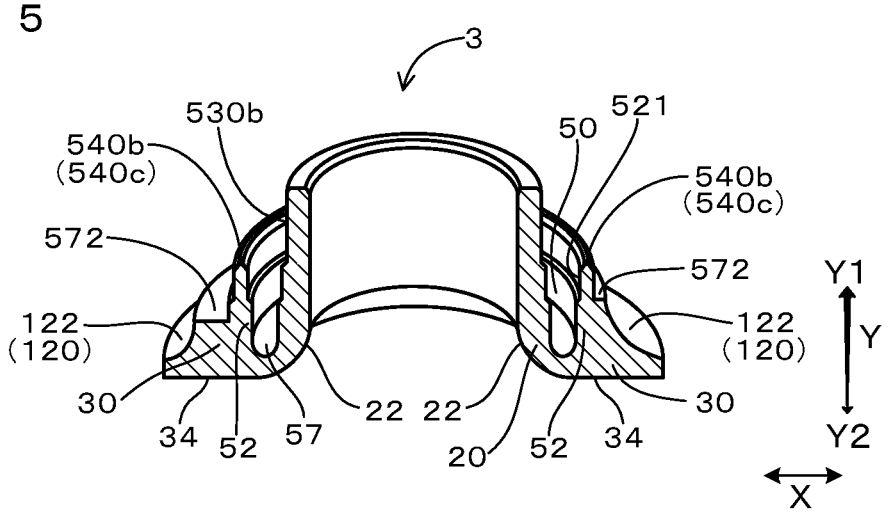
FIG. 5 is a perspective, cross-sectional view of the shroud piece in accordance with Embodiment 1.

The scroll piece 2 and the shroud piece 3 are assembled to each other by press-fitting in the axial direction Y a press-fitting portion 530*b* of the shroud piece 3 that is shown in FIG. 5 into a press-fitted portion 530*a* of the scroll piece 2 that is shown in FIG. 3.

Figure 7A:
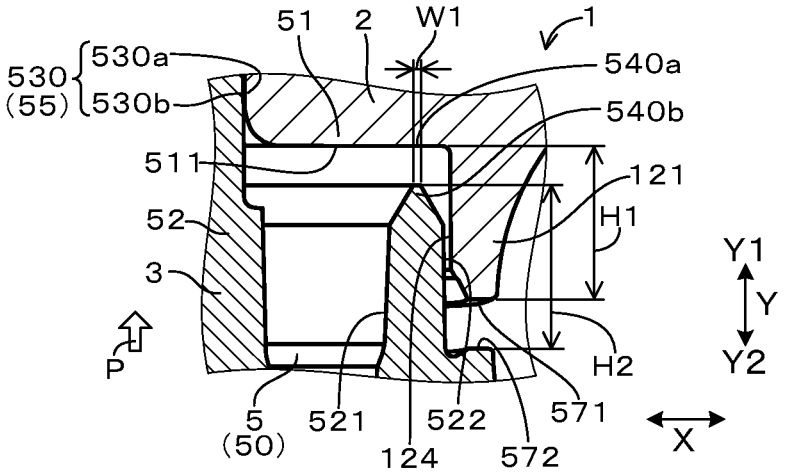
FIGS. 7A, 7B, and 7C are a series of schematic diagrams of an enlarged substantial part for illustrating the method for manufacturing the compressor housing for a turbocharger in accordance with Embodiment 1.
Figure 7B:
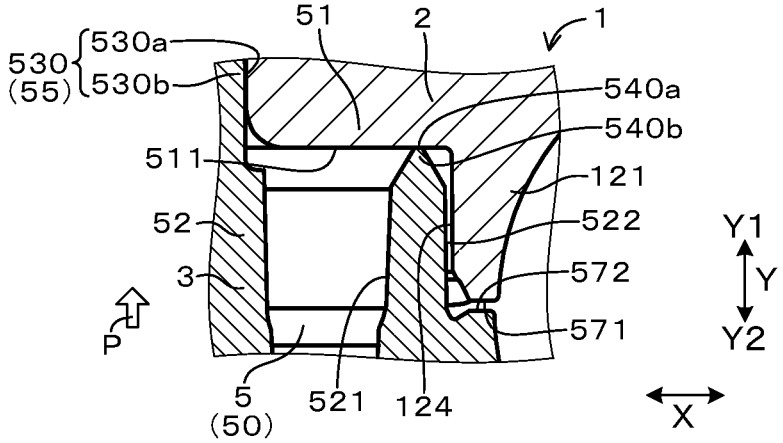
Figure 7C:
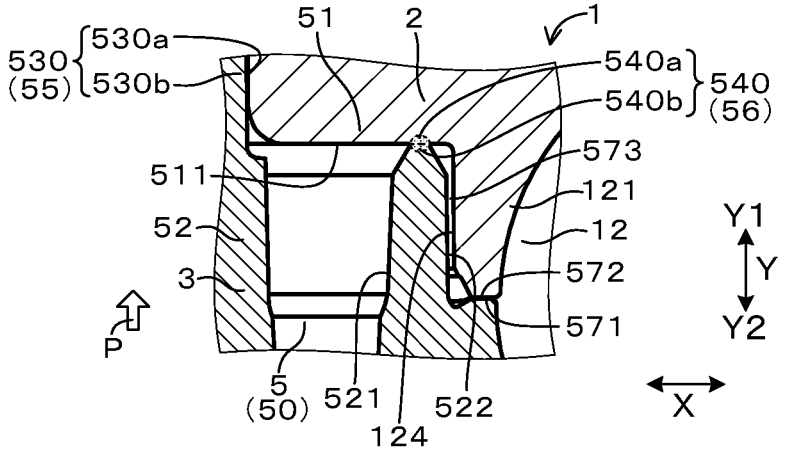

Next, as shown in FIGS. 7A to 7C, a pressure-contacting portion 540*b* provided to either one of the scroll piece 2 and the shroud piece 3 is pressure-contacted to a pressure-contacted portion 540*a* provided to the other one of the scroll piece 2 and the shroud piece 3, and a plastic flow portion 540 is annularly formed by plastic flow of the pressure-contacting portion 540*b* and the pressure-contacted portion 540*a*. In this way, the scroll piece 2 and the shroud piece 3 are sealed with each other.

Hereinafter, the compressor housing 1 for a turbocharger according to the present embodiment will be described in detail.

As shown in FIG. 2, the compressor housing 1 for a turbocharger has a three-piece structure that is dividably formed of the scroll piece 2, the shroud piece 3, and an outer circumference annular piece 4 that are formed separately.

As shown in FIGS. 2 and 3, the scroll piece 2 includes the intake port 11, a first scroll chamber formation part 121, an outer peripheral portion 125, and a first refrigerant flow-path formation part 51. As shown in FIGS. 2 and 5, the shroud piece 3 includes a second scroll chamber formation part 122, the shroud part 20, a diffuser part 30, and a second refrigerant flow-path formation part 52. As shown in FIG. 2, the outer circumference annular piece 4 includes a third scroll chamber formation part 123 and an outer circumference annular piece insertion portion 41.

As shown in FIGS. 2 and 3, the intake port 11 of the scroll piece 2 is penetratingly formed in an axial direction Y with a cylindrical intake port formation part 10. The first scroll chamber formation part 121 constitutes a wall surface of the scroll chamber 12 on an intake side Y1. As shown in FIG. 2, the outer peripheral portion 125 is located on a side Y2 that is opposite to the intake side Y1 on which the first scroll chamber formation part 121 is located, to form an outer peripheral portion of the compressor housing 1 for a turbocharger. The outer circumference annular piece 4 is provided inside of the outer peripheral portion 125.

As shown in FIG. 2, the second scroll chamber formation part 122 of the shroud piece 3 forms a wall surface of the scroll chamber 12 on the inner circumferential side. The shroud part 20 forms a shroud surface 22 that faces the compressor impeller 13. The diffuser part 30 forms a diffuser surface 34 that extends from the shroud surface 22 toward the scroll chamber 12. Between the diffuser surface 34 and a facing surface 37, a diffuser passage 15 is formed. The facing surface 37 is formed in a bearing housing 7 to which the compressor housing is attached, at the position so as to face the diffuser surface 34 at a predetermined distance, and is almost parallel to the diffuser surface 34. The diffuser passage 15 is formed in the circumferential direction outside of the compressor impeller 13 and pressurizes the air discharged from the compressor impeller 13.

Figure 4:
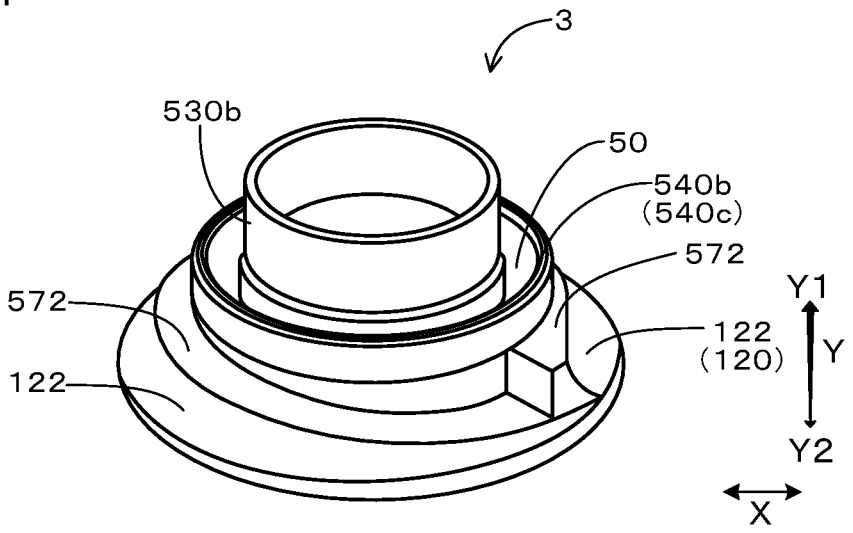
FIG. 4 is a perspective view of a shroud piece in accordance with Embodiment 1.

As shown in FIG. 3, the press-fitted portion 530*a* is provided on the side Y2 of the intake port formation part 10 of the scroll piece 2, which is opposite to the intake side Y1. The press-fitted portion 530*a* has a cylindrical inner circumference surface. On the other hand, as shown in FIG. 4, the press-fitting portion 530*b* is provided on the intake side Y1 of the shroud piece 3. The press-fitting portion 530*b* has a cylindrical outer circumference surface.

The press-fitting portion 530*b* of the shroud piece 3 is press-fitted into the inside of the press-fitted portion 530*a* of the scroll piece 2, so that the shroud piece 3 and the scroll piece 2 are assembled to each other as shown in FIG. 2. The press-fitting portion 530*b* and the press-fitted portion 530*a* are in contact with each other entirely in the circumferential direction to form a press-fit formation portion 530. It is noted that a tightening margin of the press-fit formation portion 530 can be set in the range such that a sufficient slip-out load can be obtained and no breakage will be caused. In the present embodiment, the scroll piece 2 and the shroud piece 3 are made of an aluminum alloy.

As shown in FIG. 2, a refrigerant flow path 5 is formed with the first refrigerant flow-path formation part 51 of the scroll piece 2 and the second refrigerant flow-path formation part 52 of the shroud piece 3 by assembling the shroud piece 3 and the scroll piece 2. As shown in FIGS. 2 and 3, the first refrigerant flow-path formation part 51 of the scroll piece 2 is located inside of the first scroll chamber formation part 121, and has a first wall surface 511 that is a wall surface of the refrigerant flow path 5 on the intake side Y1. In the present embodiment, the first wall surface 511 forms a flat surface that is perpendicular to the axial direction Y. It is noted that the first wall surface 511 is not necessarily flat, and may be recessed toward the intake side Y1.

As shown in FIG. 2, the second refrigerant flow-path formation part 52 of the shroud piece 3 is provided on the intake side Y1 with respect to the diffuser part 30. As shown in FIG. 5, the second refrigerant flow-path formation part 52 has a second wall surface 521 that is formed in a recessed shape recessed toward the Y2 side opposite to the intake side Y1. In the present embodiment, the second wall surface 521 is formed in a U-shape in the cross section that is parallel to the axial direction Y, and forms an annular recess that extends in the circumferential direction outside of the shroud surface 22 in the radial direction. As shown in FIG. 2, the second refrigerant flow-path formation part 52 has a second contact surface 572 that forms a wall surface parallel to the radial direction outside the second wall surface 521 in the radial direction. The second contact surface 572 is in contact with a first contact surface 571 of the scroll piece 2. And, an annular space 50 that is defined by the first refrigerant flow-path formation part 51 and the second refrigerant flow-path formation part 52 forms the refrigerant flow path 5. The refrigerant flow path 5 is formed in the circumferential direction along the diffuser part 30, and allows a refrigerant for cooling the diffuser part 30 to pass therethrough.

As shown in FIG. 2, the refrigerant flow path 5 is sealed by an inner circumferential seal part 55 that is located inside of the refrigerant flow path 5 and an outer circumferential seal part 56 that is located outside of the refrigerant flow path 5 at the boundary of the first refrigerant flow-path formation part 51 and the second refrigerant flow-path formation part 52. The inner circumferential seal part 55 is formed of the press-fit formation portion 530 that is formed by press-fitting the press-fitting portion 530*b* into the press-fitted portion 530*a* as mentioned above. The press-fitting is performed until the first contact surface 571 and the second contact surface 572 are brought in contact with each other. The outer circumferential seal part 56 is formed of the plastic flow portion 540 as shown in FIG. 2. As shown in FIG. 7C, the plastic flow portion 540 is formed by plastic flow of the pressure-contacted portion 540*a* and the pressure-contacting portion 540*b* which is caused by pressure-contacting the pressure-contacting portion 540*b* of the shroud piece 3 with the pressure-contacted portion 540*a* of the scroll piece 2 in the axial direction Y. Thus, a micro-order gap at the plastic flow portion 540 can be filled.

As shown in FIGS. 2 and 3, the pressure-contacted portion 540*a* in the non-assembled state forms a flat surface parallel to the radial direction X in an annular state. In the present embodiment, the pressure-contacted portion 540*a* forms a flat surface extending from the first wall surface 511 outwardly in the radial direction.

On the other hand, as shown in FIGS. 4 and 5, the pressure-contacting portion 540*b* in the non-assembled state is formed on a ridgeline portion 540*c*. The ridgeline portion 540*c* corresponds to a portion of the outer circumferential side wall of the refrigerant flow path 5 on the intake side Y1, and projects convexly toward the intake side Y1. As shown in FIG. 5, the ridgeline portion 540*c* has a cross-section having a mountain shape, the peak of which continues in the circumferential direction to have an annular shape. The edge of the ridgeline portion 540*c* on the intake side Y1 forms the pressure-contacting portion 540*b*. As shown in FIG. 7A, a formation range of the pressure-contacting portion 540*b* in the radial direction X, i.e. a width W1 is set to a dimension enough to secure a sufficient amount of plastic flow, for example, it may be set to 0.2-0.5 mm. Plastic flow at the plastic flow portion 540 is caused mainly in the pressure-contacting portion 540*b* because the pressure-contacting portion 540*b* is formed projectingly as mentioned above.

In the present embodiment, in the non-assembled state as shown in FIG. 7A, a height H2 of the pressure-contacting portion 540*b* from the second contact surface 572 is larger than a height H1 of the pressure-contacted portion 540*a* from the first contact surface 571 as viewed in a cross section including a rotation shaft 13*a*. Therefore, as shown in FIG. 7B, the pressure-contacting portion 540*b* and the pressure-contacted portion 540*a* are pressure-contacted with each other to cause plastic flow before the first contact surface 571 and the second contact surface 572 are brought into contact with each other at the time of press-fitting. The difference of the heights H1 and H2 determines the plastic flow amount at the plastic flow portion 540. H2−H1, the difference of the heights H1 and H2 may be set to, for example, 20-60 μm, and in the present embodiment, it is set to 40 μm.

As shown in FIGS. 2 and 3, the scroll piece 2 has a refrigerant feed part 513 and a refrigerant discharge part 514 formed as a through-hole that is formed through the first refrigerant flow-path formation part 51 and communicated with the refrigerant flow path 5. The refrigerant feed part 513 is configured to feed a refrigerant to the refrigerant flow path 5, and the refrigerant discharge part 514 is configured to discharge the refrigerant. In the present embodiment, as shown in FIG. 2, the refrigerant feed part 513 and the refrigerant discharge part 514 are formed from the first wall surface 511 toward the intake side Y1 in parallel to the axial direction Y, and then directed outward in the radial direction.

As shown in FIG. 2, an outer circumference annular piece insertion portion 41 of the outer circumference annular piece 4 is inserted into the inside of the outer peripheral portion 125 of the scroll piece 2. A first scroll chamber formation part 121 of the scroll piece 2 and a third scroll chamber formation part 123 of the outer circumference annular piece 4 are configured to have a slight gap B therebetween such that both parts are not in contact with each other. According to this configuration, the outer circumference annular piece 4 is inserted to the predetermined position, so that diffuser passage 15 is formed with a predetermined width.

A method for manufacturing the compressor housing 1 for a turbocharger according to the present embodiment will be described.

Figure 6:
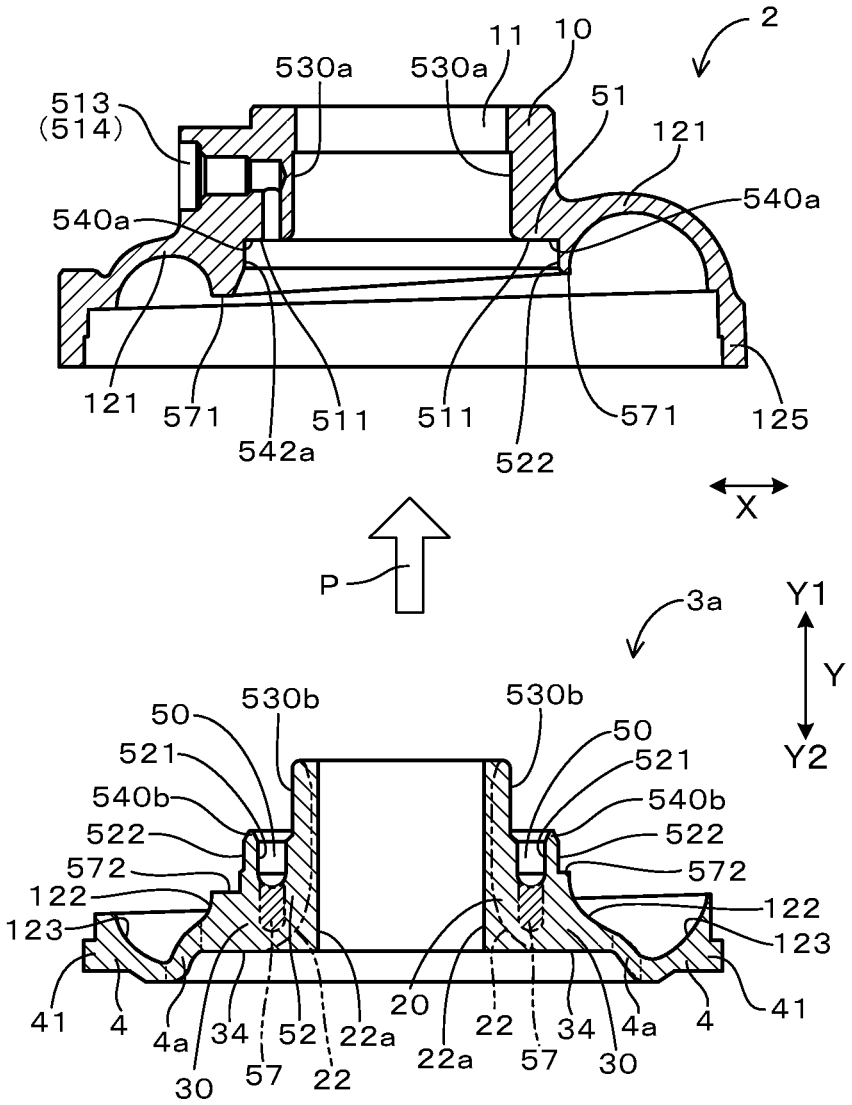
FIG. 6 is a schematic diagram for illustrating a method for manufacturing the compressor housing for a turbocharger in accordance with Embodiment 1.

First, as shown in FIG. 6, the scroll piece 2 is molded by die casting. And, an integral piece 3*a* is molded by die casting. The integral piece 3*a* is composed of the outer circumference part of the shroud piece 3 and the inner circumference part of the outer circumference annular piece 4 that are connected and integrated through a connecting portion 4*a*. Then, by machining, the press-fitted portion 530*a* and the pressure-contacted portion 540*a* are formed on the scroll piece 2, and the press-fitting portion 530*b* and the pressure-contacting portion 540*b* are formed on the shroud piece 3. And then, a bottom portion of the second wall surface 521, i.e. a cut part 57 is cut. It is noted that the shroud surface 22 is not formed on the integral piece 3*a*, an inside surface 22*a* of the integral piece 3*a* forms a cylindrical surface.

Figure 8:
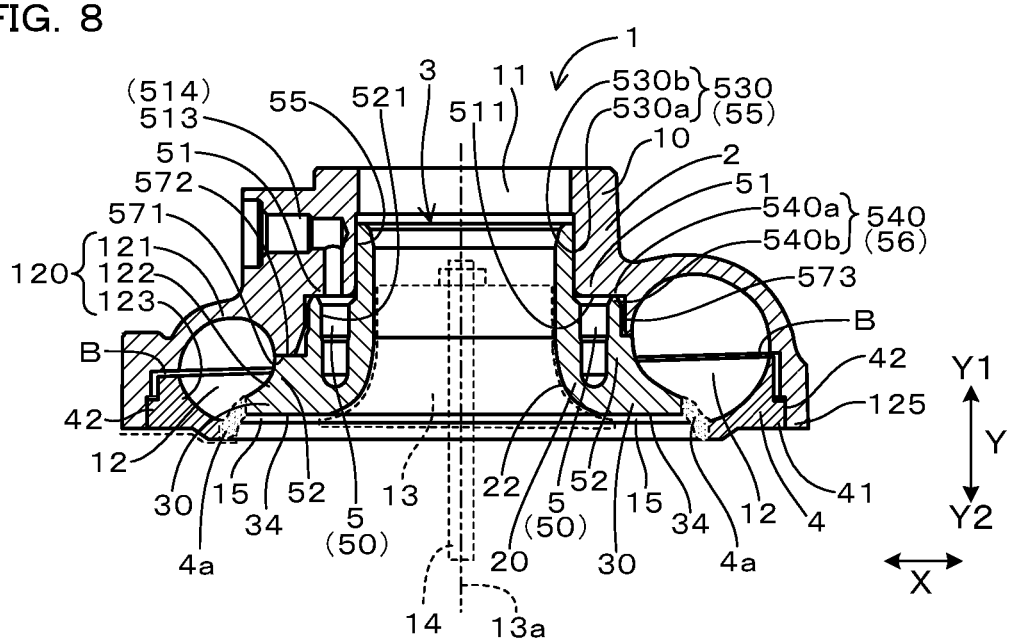
FIG. 8 is a schematic diagram for illustrating the method for manufacturing the compressor housing for a turbocharger in accordance with Embodiment 1.

Then, as shown in FIG. 6, the integral piece 3*a* is press-fitted into the scroll piece 2 in the direction of an arrow P (the intake side Y1 direction). Thus, first of all, the press-fitting portion 530*b* is press-fitted into the press-fitted portion 530*a* as shown in FIG. 7A, and the pressure-contacting portion 540*b* and the pressure-contacted portion 540*a* are brought in contact with each other in the axial direction Y as shown in FIG. 7B. And, by continuously performing the press-fitting until the first contact surface 571 is brought into contact with the second contact surface 572, the pressure-contacting portion 540*b* and the pressure-contacted portion 540*a* are pressure-contacted with each other in the axial direction Y, so that both portions plastically flow to thereby form the plastic flow portion 540 as shown in FIG. 7C. Consequently, as shown in FIG. 8, the refrigerant flow path 5 serving as the annular space 50 is formed by the first refrigerant flow-path formation part 51 and the second refrigerant flow-path formation part 52, and at the same time, the inner circumferential seal part 55 for sealing the inner circumferential side of the refrigerant flow path 5 is formed by the press-fitting portion 530*b* and the press-fitted portion 530*a*, and the plastic flow portion 540 forms an outer circumferential seal part for sealing the outer circumferential side of the refrigerant flow path 5. It is noted that as shown in FIG. 7C, a side circumferential surface 522 of the second refrigerant flow-path formation part 52, which faces outward in the radial direction, opposes a side circumferential surface 124 of the first scroll chamber formation part 121, which faces inward in the radial direction. Both side circumferential surfaces are spaced from each other to form a space 573.

Then, by cutting off the connecting portion 4*a* that is shown in FIG. 8, the shroud piece 3 and the outer circumference annular piece 4 are separated from each other under the state in which the shroud piece 3 and the outer circumference annular piece 4 are press-fitted into the scroll piece 2, and at the same time the inside surface 22*a* is machined to form the shroud surface 22. Thus, the compressor housing 1 for a turbocharger according to the present embodiment shown in FIG. 2 is manufactured.

It is noted that the tightening margin of a press-fitting portion 42 that is formed by press-fitting the outer circumference annular piece 4 is preferably smaller than that of the press-fitting portion 530*b*. In this case, the work for press-fitting the integral piece 3*a* into the scroll piece 2 can be easily performed. In addition, deviation of the coaxiality between the press-fitting portion 530*b* of the shroud piece 3 and the press-fitting portion 42 of the outer circumference annular piece 4 can be absorbed.

Next, operational effects of the compressor housing 1 for a turbocharger according to the present embodiment will be described in detail.

In the compressor housing 1 for a turbocharger of the present embodiment, the plastic flow portion 540 that is annularly formed between the scroll piece 2 and the shroud piece 3 is formed by plastic flow caused by pressure-contacting the pressure-contacted portion 540*a* that is provided on either one of the scroll piece 2 and the shroud piece 3, and the pressure-contacting portion 540*b* that is provided on the other one of the scroll piece 2 and the shroud piece 3 with each other, so that micro gaps are filled to thereby achieve high sealability. And, because the pressure-contacted portion 540*a* and the pressure-contacting portion 540*b* are pressure-contacted in the axial direction Y at the plastic flow portion 540, it is possible to achieve an improvement in sealability of the plastic flow portion 540 by increasing the supporting rigidity at the plastic flow portion 540 while keeping the shape of the scroll chamber 12 formed outside of the diffuser part 30 unchanged even in the case where it is difficult to secure the wall thickness of the plastic flow portion in the radial direction X. In addition, because there is no need to use any separate components such as an O-ring for the purpose of sealing a refrigerant flow path 5, cost reduction can be achieved.

In the present embodiment, the scroll piece 2 and the shroud piece 3 have contact surfaces 571 and 572 at the different position from the positions of the pressure-contacting portion 540*b* and the pressure-contacted portion 540*a* respectively, through which the pressure-contacting portion 540*b* and the pressure-contacted portion 540*a* are in contact with each other in the axial direction Y to determine the press-fitting position of the press-fitting portion 530*b*. According to such a configuration, the plastic flow portion 540 is formed in the state in which the shroud piece 3 is press-fitted into the prescribed press-fitting position with respect to the scroll piece 2, and thus the prescribed plastic flow amount is secured to thereby achieve improvement in sealability.

In the present embodiment, there is provided the refrigerant flow path 5 that is formed in the circumferential direction along the diffuser part 30 and allows a refrigerant for cooling the diffuser part to pass therethrough. And, the refrigerant flow path 5 is formed as the annular space 50 that is constituted by a first refrigerant flow-path formation part 51 of the scroll piece 2 and a second refrigerant flow-path formation part 52 of the shroud piece 3, the first refrigerant flow-path formation part 51 and the second refrigerant flow-path formation part 52 being formed respectively at each opposing part of the scroll piece 2 and the shroud piece 3 which oppose each other. On the inner circumferential side of the refrigerant flow path 5, the annular inner circumferential seal part 55 is formed by press-fitting the press-fitting portion 530*b* into the press-fitted portion 530*a*, and on the outer circumferential side of the refrigerant flow path 5, the annular outer circumferential seal part 56 composed of the plastic flow portion 540 is formed. The refrigerant flow path 5 is sealed by the inner circumferential seal part 55 and the outer circumferential seal part 56. Having such a configuration, there is no need for the compressor housing 1 for a turbocharger having the refrigerant flow path 5 provided therein to increase the supporting rigidity in the radial direction even on the outer circumferential side of the refrigerant flow path 5, which includes a portion hardly securing a sufficient wall thickness, and thus it is possible to achieve an improvement in sealability at the refrigerant flow path 5 compatibly with cost reduction while keeping the shape of the scroll chamber unchanged.

A method for manufacturing the compressor housing 1 for a turbocharger according to the present embodiment includes molding the scroll piece 2 and the shroud piece 3 by die-casting, machining the scroll piece 2 and the shroud piece 3 to form either one of the pressure-contacting portion 540*b* and the pressure-contacted portion 540*a*, and the other one of the pressure-contacting portion 540*b* and the pressure-contacted portion 540*a*, respectively, and assembling the scroll piece 2 and the shroud piece 3 to each other by press-fitting the press-fitting portion 530*b* into the press-fitted portion 530*a* while pressure-contacting the pressure-contacting portion 540*b* with the pressure-contacted portion 540*a* in the axial direction to cause plastic flow thereto and form the plastic flow portion 540.

In this way, the compressor housing 1 for a turbocharger according to the present embodiment can be manufactured. And, because the pressure-contacted portion 540*a* and the pressure-contacting portion 540*b* are formed by machining in the machining step, the surfaces thereof can be made rough to some extent in comparison with a cast surface made by die-casting, which makes it possible to easily cause plastic flow to the pressure-contacting portion 540*b* and the pressure-contacted portion 540*a* during the assembling, so that the sealability of the plastic flow portion 540 can be enhanced.

In the present embodiment, in the machining, the pressure-contacting portion 540*b* is formed on a ridgeline portion 540*c* that projects convexly to the pressure-contacted portion 540*a*. According to this configuration, the pressure-contacting portion 540*b* is allowed to plastically flow with ease when the pressure-contacting portion 540*b* is pressure-contacted to the pressure-contacted portion 540*a*, so that the plastic flow portion 540 is easily formed.

In the compressor housing 1 for a turbocharger according to the present embodiment, as shown in FIG. 8, a part of the integrated piece 3*a* for constituting the outer circumference annular piece 4 is not brought into contact with the scroll piece 2 in the axial direction to thereby form a gap B. Therefore, the first contact surface 571 can be brought in contact with the second contact surface 572 when the integral piece 3*a* is press-fitted. Consequently, positioning of the integral piece 3*a* when being press-fitted in the axial direction can be made further accurately. In other words, positioning for completion in the axial direction of the shroud piece 3 can be made further accurately.

In the present embodiment, the compressor housing 1 for a turbocharger has a three-piece structure composed of the scroll piece 2, the shroud piece 3, and the outer circumference annular piece 4, and the scroll chamber 12 is formed by assembling these three pieces, i.e. the scroll piece 2, the shroud piece 3, and the outer circumference annular piece 4. Thus, the scroll chamber 12 can be formed to have a circular cross section, and the scroll chamber formation part 120 can be formed into a shape having no undercut which can be formed by die-cutting. As a result, the compression efficiency for supplied air can be improved, and the scroll chamber formation part 120 can be easily formed by die casting.

Figure 9:
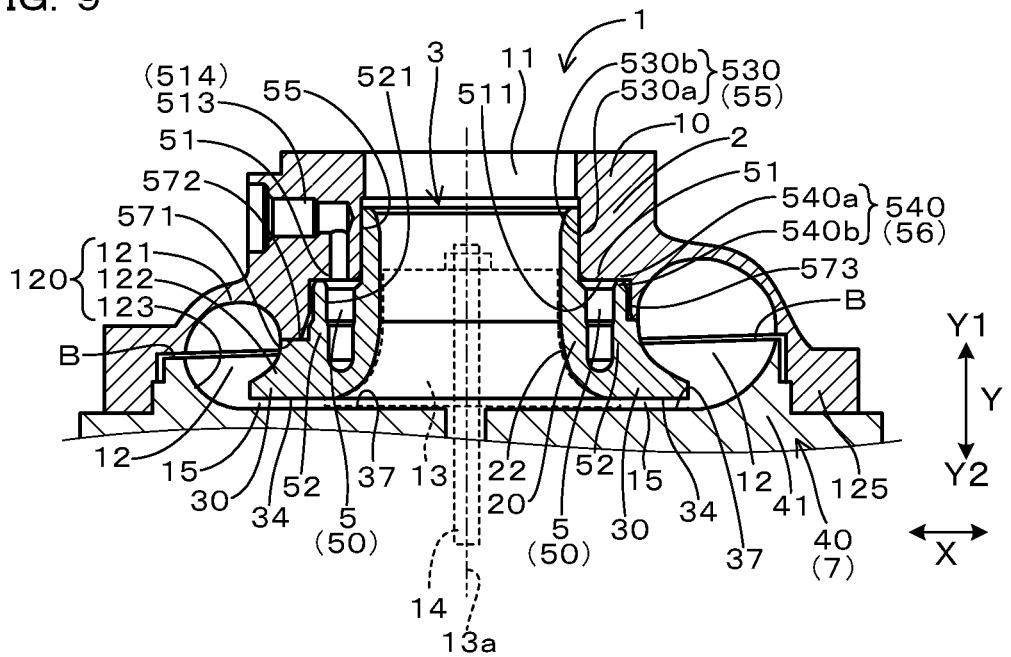
FIG. 9 is a cross-sectional view of a compressor housing for a turbocharger in accordance with Modification 1, which is taken along a line corresponding to the line II-II of FIG. 1.

It is noted that the compressor housing for a turbocharger may be of a two-piece structure that is composed of the scroll piece 2 and the shroud piece 3, incorporating the configuration of the outer circumference annular piece 4 into a seal plate 40 as shown in Modification 1 in FIG. 9.

As described above, according to the present embodiment and the modification, there can be provided a compressor housing for a turbocharger that makes it possible to achieve an improvement in sealability compatibly with cost reduction.

Embodiment 2

Figure 10:
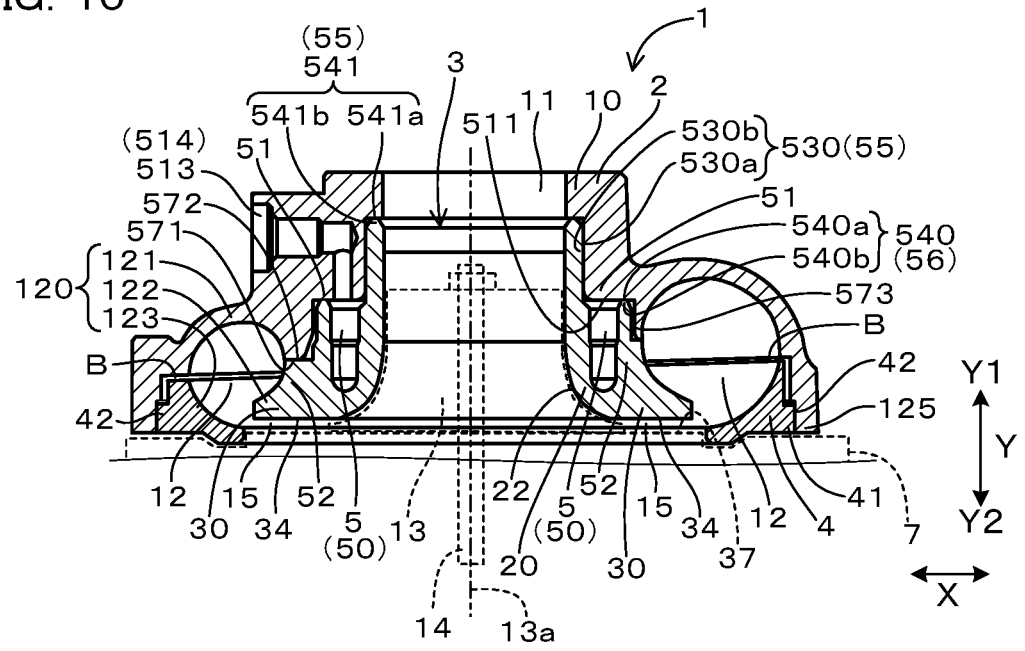
FIG. 10 is a cross-sectional view of a compressor housing for a turbocharger in accordance with Embodiment 2, which is taken along a line corresponding to the line II-II of FIG. 1.

In the compressor housing 1 for a turbocharger according to the present embodiment, as shown in FIG. 10, the inner circumferential seal part 55 includes the press-fit formation portion 530 and a plastic flow portion 541. The press-fit formation portion 530 is formed in the same way as in Embodiment 1. The plastic flow portion 541 is formed by plastic flow caused to the pressure-contacted portion 541*a* and the pressure-contacting portion 541*b* by pressure-contacting both portions with each other in the axial direction Y. Thus, a micro-order gap at the plastic flow portion 541 can be filled.

Figure 11:
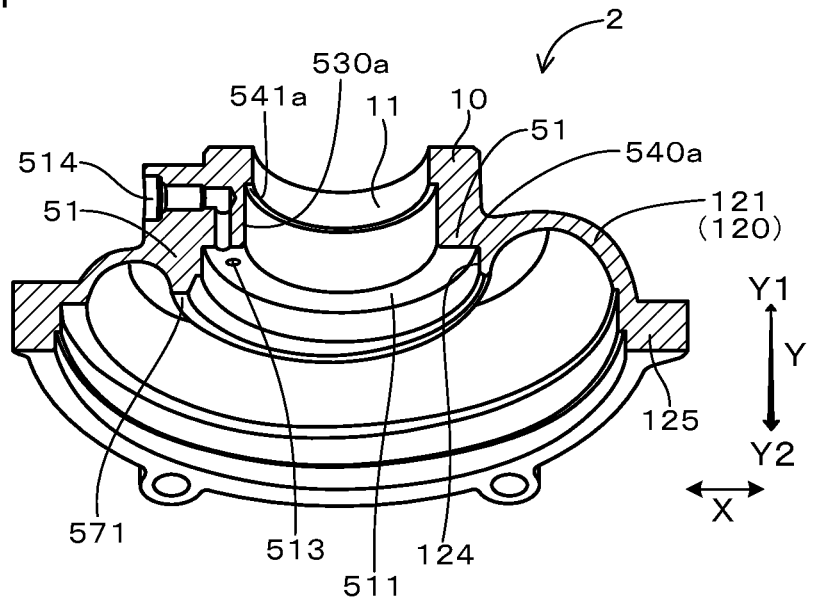
FIG. 11 is a perspective, cross-sectional view of a scroll piece in accordance with Embodiment 2.

As shown in FIG. 11, the pressure-contacted portion 541*a* in the non-assembled state forms a flat surface parallel to the radial direction X on the scroll piece 2 in an annular state in the same way as for the pressure-contacted portion 540*a*. In the present embodiment, the pressure-contacted portion 541*a* is located on the intake side Y1 with respect to the press-fitted portion 530*a*.

Figure 12:
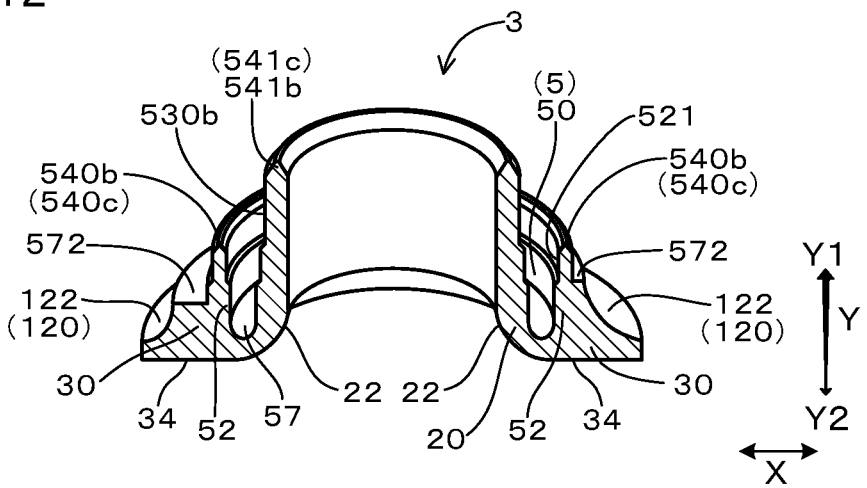
FIG. 12 is a perspective, cross-sectional view of a shroud piece in accordance with Embodiment 2.
Figure 13A:
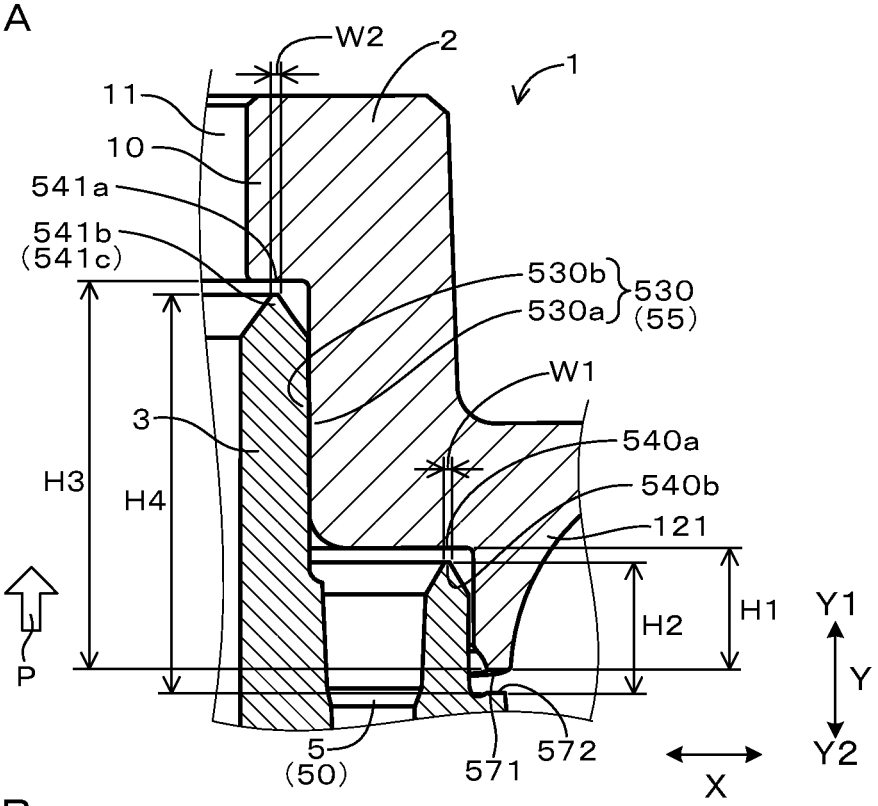
FIGS. 13A and 13B are a series of schematic diagrams of an enlarged substantial part for illustrating a method for manufacturing the compressor housing for a turbocharger in accordance with Embodiment 2.
Figure 13B:
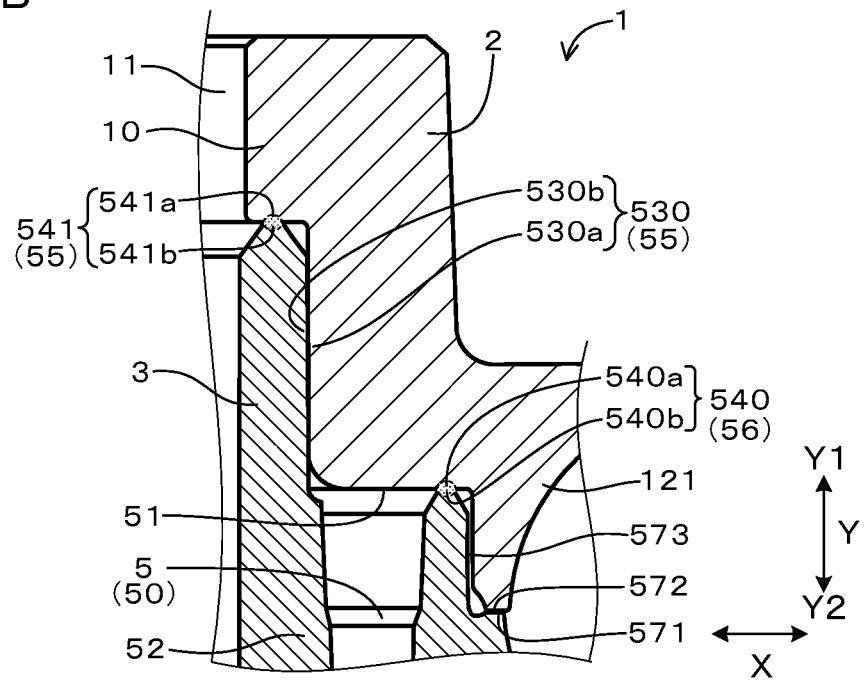

On the other hand, as shown in FIG. 12, the pressure-contacting portion 541*b* in the non-assembled state is formed on a ridgeline portion 541*c* of the shroud piece 3. The ridgeline portion 541*c* corresponds to a portion of the inner circumferential side wall of the refrigerant flow path 5 on the intake side Y1, and projects convexly toward the intake side Y1. The ridgeline portion 541*c* has a cross-section having a mountain shape like the ridgeline portion 540*c* in Embodiment 1, the peak of which continues in the circumferential direction to form an annular shape. And, the edge of the ridgeline portion 541*c* on the intake side Y1 forms the pressure-contacting portion 541*b*. As shown in FIG. 13A, a formation range of the pressure-contacting portion 541*b* in the radial direction X, i.e. a width W2 is set to be equal to the width W1 of the pressure-contacting portion 540*b* in Embodiment 1. Plastic flow at the plastic flow portion 541 is caused mainly in the pressure-contacting portion 541*b* because the pressure-contacting portion 541*b* is formed projectingly toward the pressure-contacted portion 541*a* as mentioned above.

In the present embodiment, in the non-assembled state as shown in FIG. 13A, a height H4 of the pressure-contacting portion 541*b* from the second contact surface 572 is larger than a height H3 of the pressure-contacted portion 541*a* from the first contact surface 571 as viewed in a cross section including the rotation shaft 13*a* (see FIG. 10). Therefore, the pressure-contacting portion 541*b* and the pressure-contacted portion 541*a* are pressure-contacted with each other to cause plastic flow before the first contact surface 571 and the second contact surface 572 are brought into contact with each other at the time of press-fitting. The difference of the heights H3 and H4 is set to be equal to the difference of the heights H1 and H2. It is noted that other configurations in Embodiment 2 are equivalent to those in Embodiment 1, and the same reference numerals as those in Embodiment 1 are allotted to eliminate repeated description.

In the present embodiment, the inner circumferential seal part 55 is provided with the plastic flow portion 541 that is formed by the plastic flow caused to the pressure-contacting portion 541*b* and the pressure-contacted portion 541*a* in addition to the press-fit formation portion 530 that is formed by press-fitting in the same manner as in Embodiment 1. Therefore, the sealability of the inner circumferential seal part 55 can be improved. It is noted that the same operational effects as in Embodiment 1 are exhibited also in the present embodiment.

Embodiment 3

Figure 14:
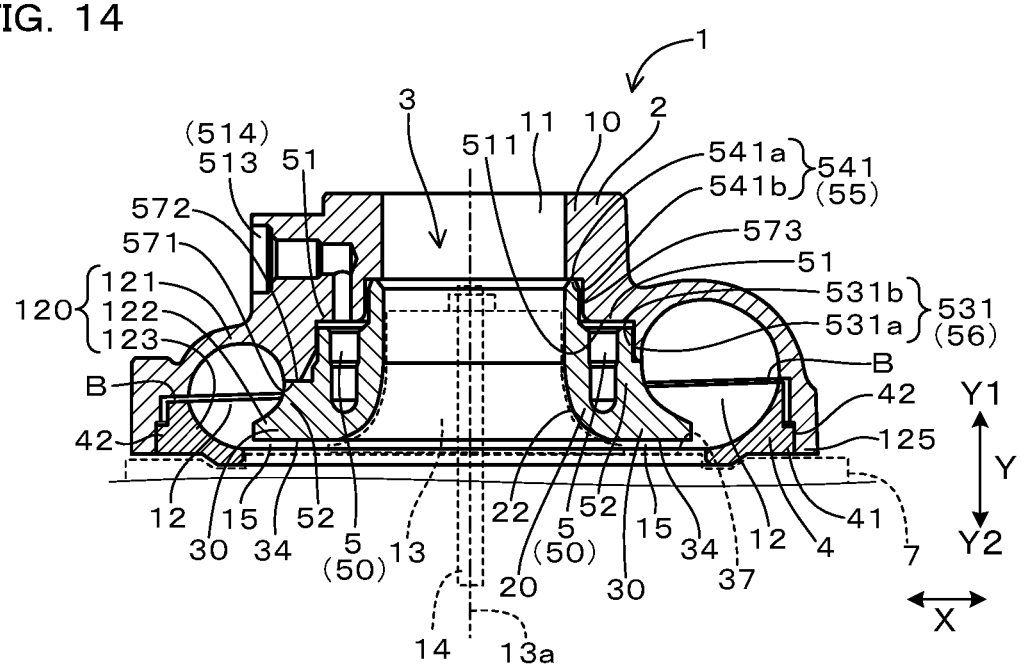
FIG. 14 is a cross-sectional view of a compressor housing for a turbocharger in accordance with Embodiment 3, which is taken along a line corresponding to the line II-II of FIG. 1.

In the compressor housing 1 for a turbocharger according to the present embodiment, as shown in FIG. 14, the inner circumferential seal part 55 includes the plastic flow portion 541 that is formed by plastic flow caused to the pressure-contacting portion 541*b* and the pressure-contacted portion 541*a*. The plastic flow portion 541 in this embodiment has the same configuration as that of the plastic flow portion 541 in Embodiment 2. However, in the present embodiment, the inner circumferential seal part 55 does not have the press-fit formation portion 530 in Embodiment 2 (see FIG. 10), and instead the outer circumferential seal part 56 is constituted by the press-fit formation portion 531 formed by press-fitting the press-fitting portion 531 *b* into the press-fitted portion 531*a*. The same reference numerals as those in Embodiments 1 and 2 are allotted to the same configurations in the present embodiment to eliminate repeated descriptions.

Figure 15:
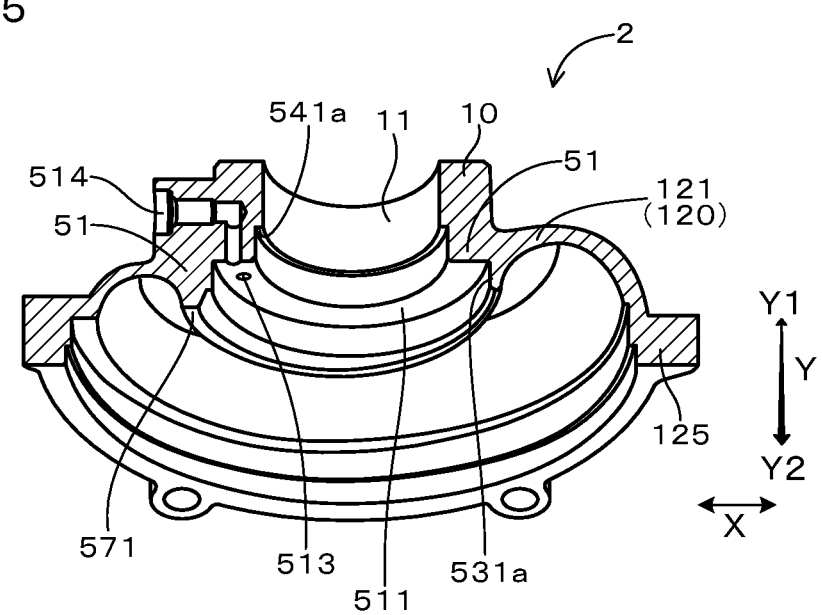
FIG. 15 is a perspective, cross-sectional view of a scroll piece in accordance with Embodiment 3.
Figure 16:
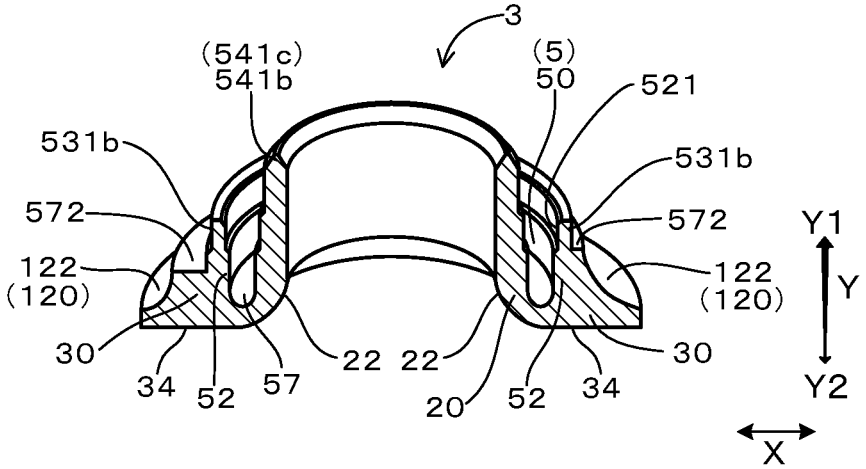
FIG. 16 is a perspective, cross-sectional view of a shroud piece in accordance with Embodiment 3.

As shown in FIG. 15, the press-fitted portion 531*a* is provided to the scroll piece 2 at a position that faces the radially inner side of the first scroll chamber formation part 121. As shown in FIG. 16, the press-fitting portion 531*b* is provided on the outer circumference surface of the outer wall of the refrigerant flow path 5 in shroud piece 3. The pressure-contacting portion 541*b* is formed on a ridgeline portion 541*c* that constitutes a portion of the inner circumferential side wall of the refrigerant flow path 5 of the shroud piece 3 on the intake side Y1. And, the pressure-contacting portion 541*b* projects convexly toward the intake side Y1.

Figure 17A:
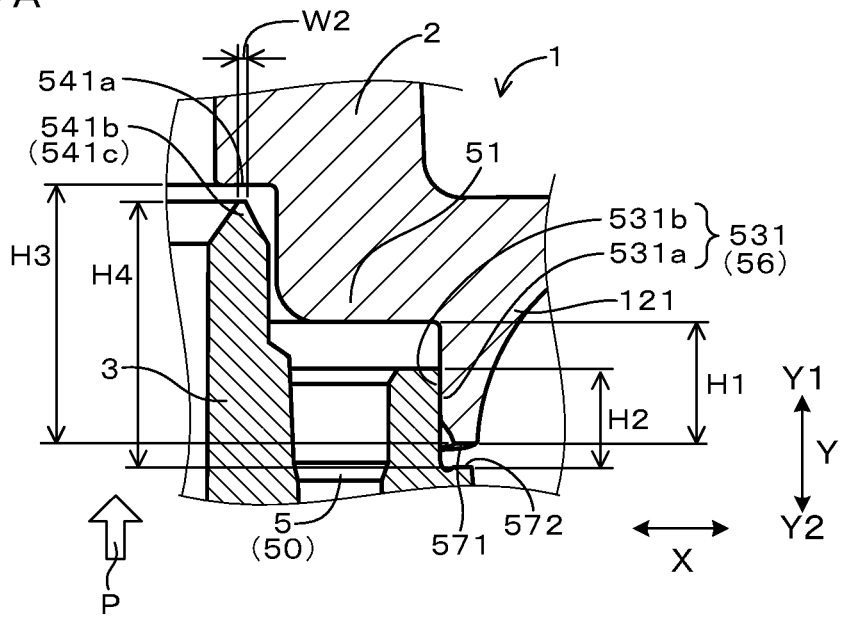
FIGS. 17A and 17B are a series of schematic diagrams of an enlarged substantial part for illustrating a method for manufacturing the compressor housing for a turbocharger in accordance with Embodiment 3.
Figure 17B:
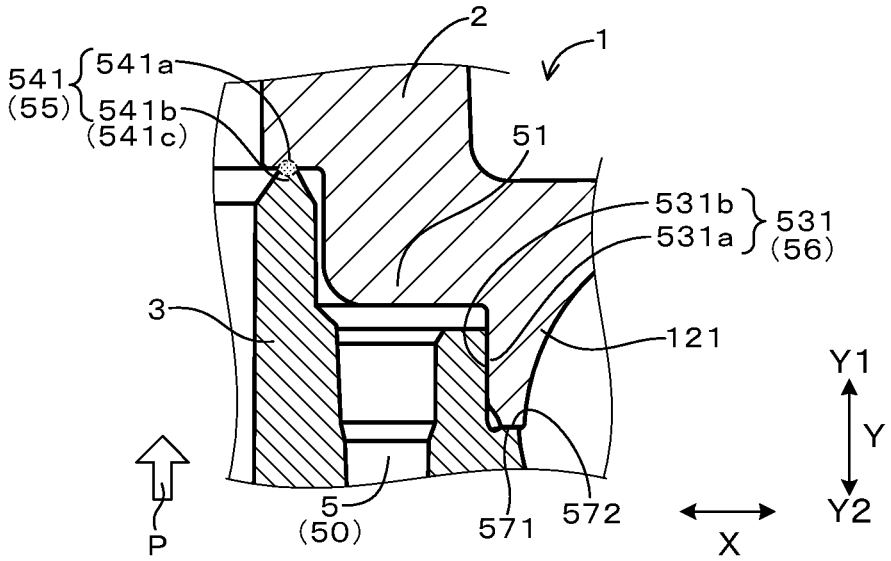

In the present embodiment, when the scroll piece 2 and the shroud piece 3 are assembled to each other, the press-fitting portion 531 *b* is press-fitted into the press-fitted portion 531*a* first as shown in FIG. 17A to thereby form a press-fit formation portion 531. And the press-fit formation portion 531 forms the outer circumferential seal part 56. In addition, by further performing the press-fitting until both contact surfaces 571 and 572 are brought into contact with each other as shown in FIG. 17B, the pressure-contacting portion 541*b* is press-contacted with the pressure-contacted portion 541*a*, so that plastic flow is caused to the pressure-contacted portion 541*a* and the pressure-contacting portion 541*b* to thereby form the plastic flow portion 541. And the plastic flow portion 541 forms the inner circumferential seal part 55.

As seen from this embodiment, if the outer circumferential seal part 56 can secure the wall thickness sufficient to obtain supportable rigidity for press-fitting, the outer circumferential seal part 56 can be formed by the press-fit formation portion 531. In this case, the inner circumferential seal part 55 can be formed by the plastic flow portion 541 only.

Embodiment 4

Figure 18:
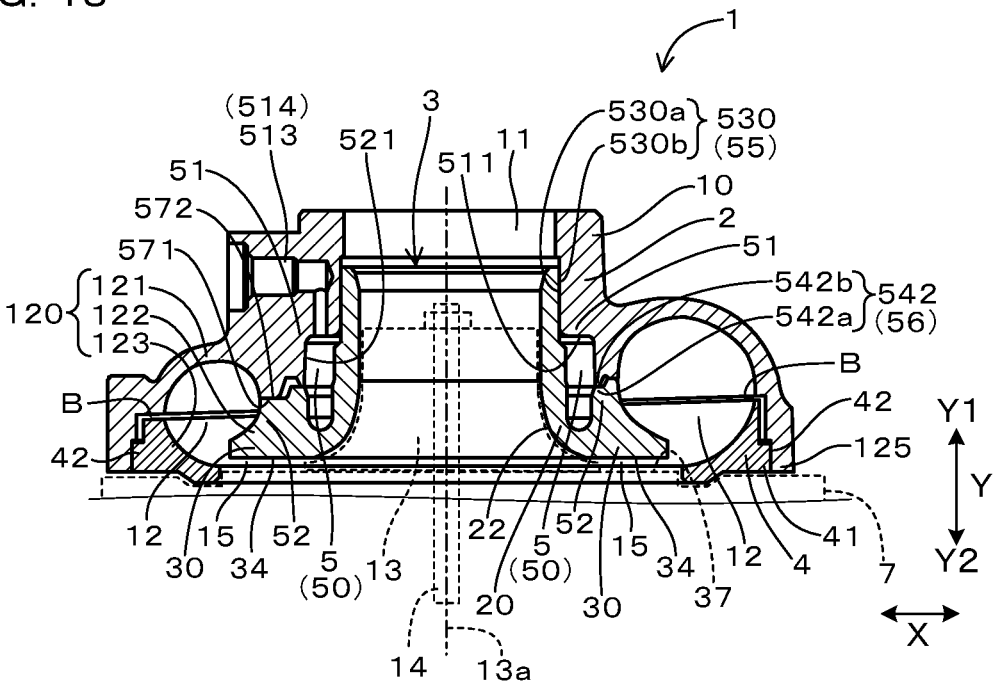
FIG. 18 is a cross-sectional view of a compressor housing for a turbocharger in accordance with Embodiment 4, which is taken along a line corresponding to the line II-II of FIG. 1.
Figure 19:
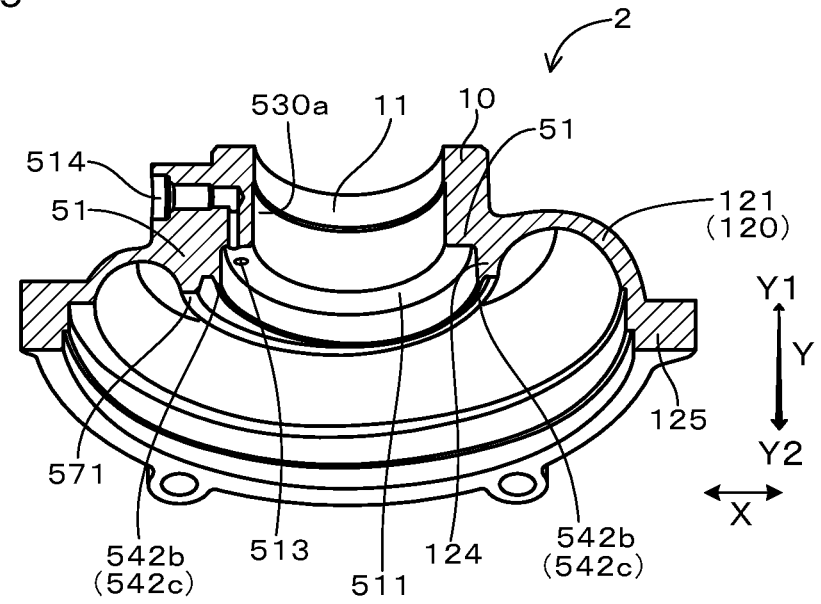
FIG. 19 is a perspective, cross-sectional view of a scroll piece in accordance with Embodiment 4.
Figure 20:
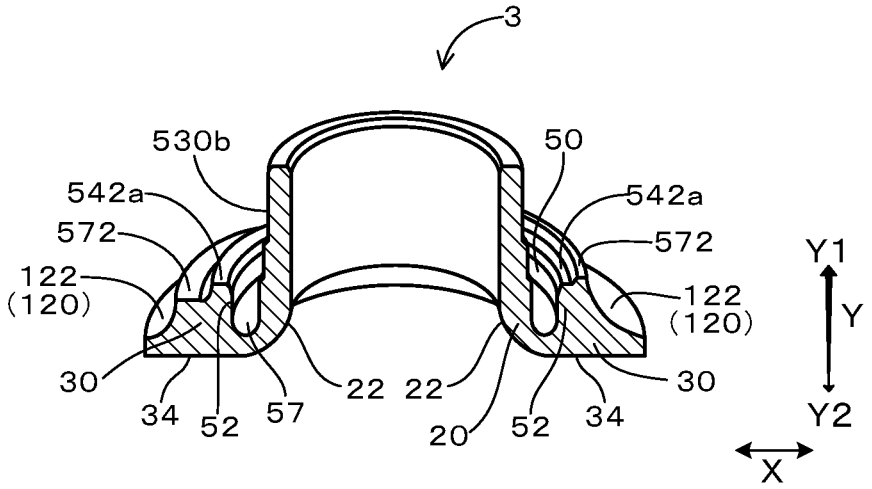
FIG. 20 is a perspective, cross-sectional view of a shroud piece in accordance with Embodiment 4.
Figure 21:
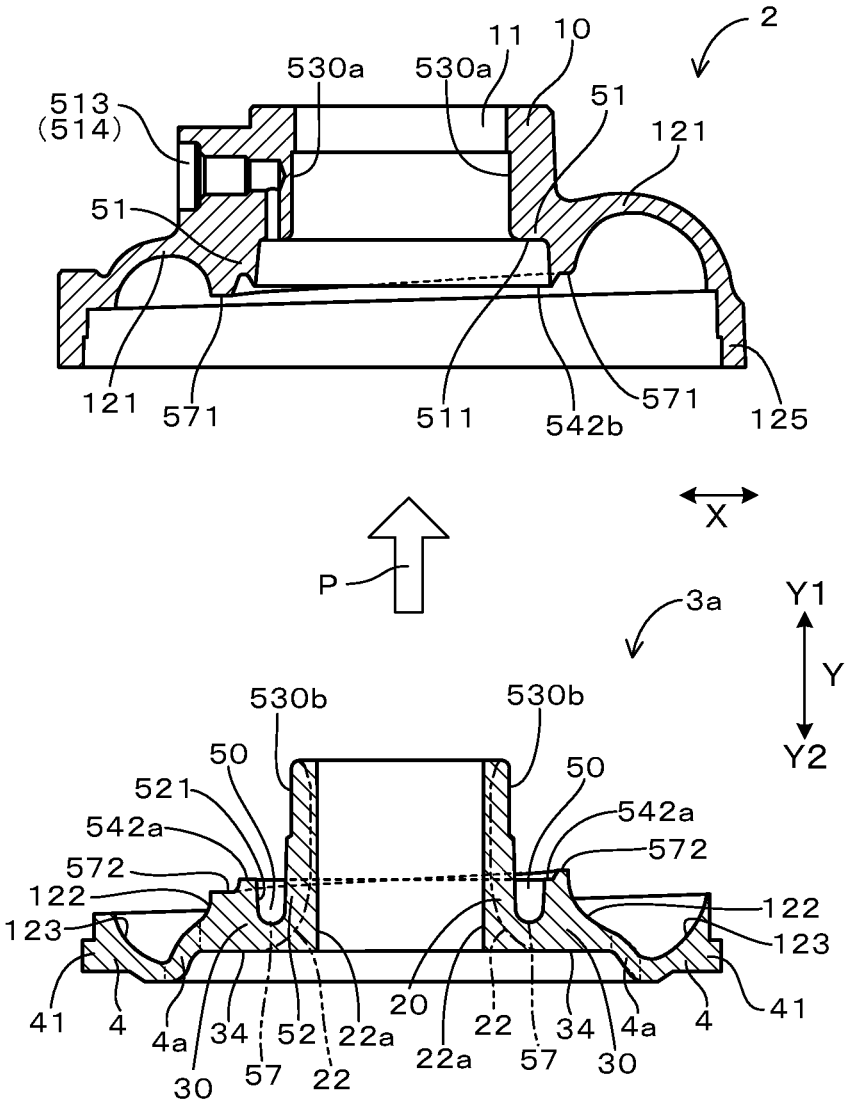
FIG. 21 is a schematic diagram for illustrating a method for manufacturing the compressor housing for a turbocharger in accordance with Embodiment 4.

In the compressor housing 1 for a turbocharger according to the present embodiment, the outer circumferential seal part 56 shown in FIG. 18 is composed of the pressure-contacting portion 542*b* provided to the scroll piece 2 shown in FIG. 19 and the pressure-contacted portion 542*a* provided to the shroud piece 3 shown in FIG. 20. As shown in FIG. 21, the pressure-contacting portion 542*b* and the pressure-contacted portion 542*a* are each formed as a surface perpendicular to the axial direction Y. On the other hand, the contact surfaces 571 and 572 are spirally formed, and are not perpendicular to the axial direction Y. In the cross section shown in FIG. 21, inclined states of the contact surfaces 571 and 572 with respect to the pressure-contacting portion 542*b* and the pressure-contacted portion 542*a*, respectively are observed.

Figure 22A:
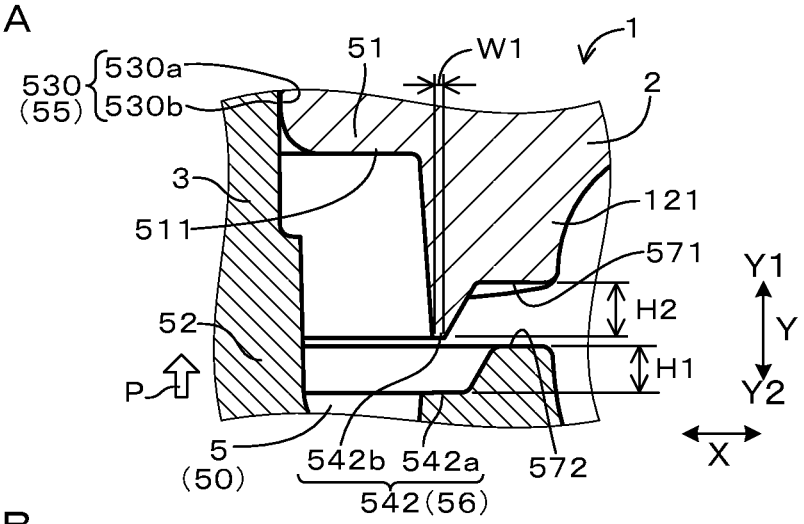
FIGS. 22A, 22B, and 22C are a series of schematic diagrams of an enlarged substantial part for illustrating a method for manufacturing the compressor housing for a turbocharger in accordance with Embodiment 4.
Figure 22B:
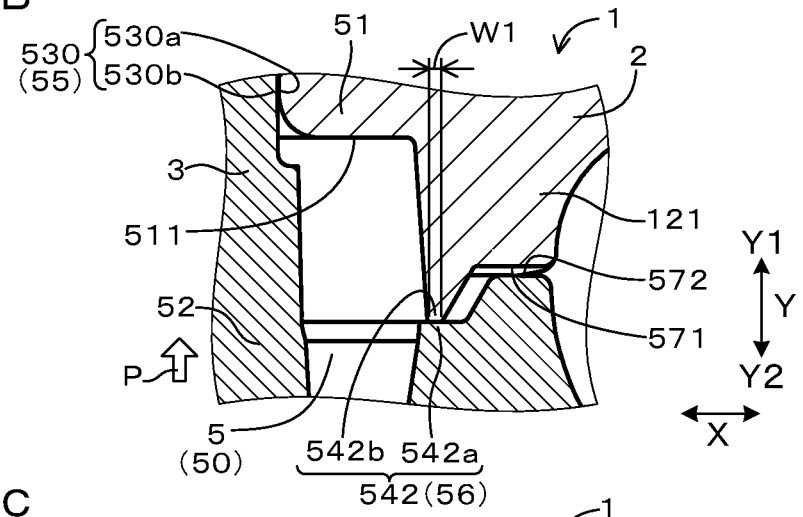
Figure 22C:
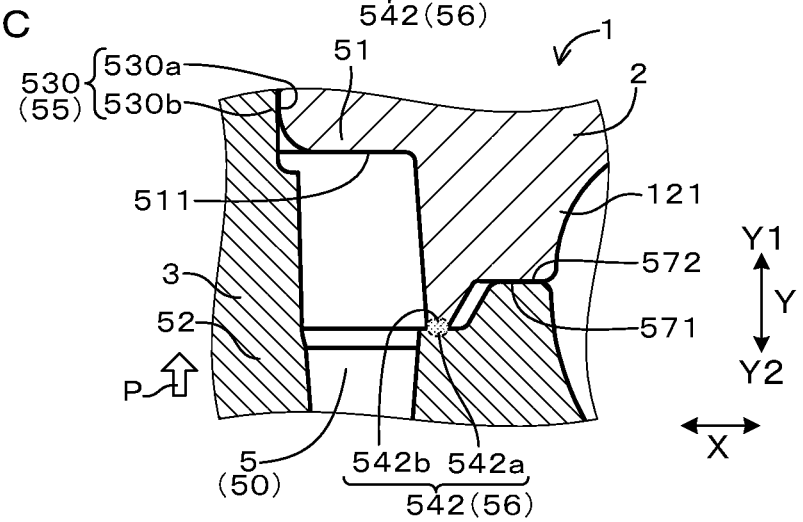

As shown in FIG. 22A, the press-fitting portion 530*b* is press-fitted into the press-fitted portion 530*a*, and as shown in FIG. 22B, the pressure-contacting portion 542*b* is pressure-contacted with the pressure-contacted portion 542*a*. By further performing the press-fitting, plastic flow is caused to the pressure-contacting portion 542*b* and the pressure-contacted portion 542*a* as shown in FIG. 22C to thereby form the plastic flow portion 542. Consequently, the plastic flow portion 542 constitutes the outer circumferential seal part 56.

In the compressor housing 1 for a turbocharger according to the present embodiment, as shown in FIG. 18, the outer circumferential seal part 56 is located closer to Y2 side than in Embodiment 1 that is shown in FIG. 2, therefore the depth of the recess of the second refrigerant flow-path formation part 52 in the shroud piece 3 is relatively shallow. Therefore, there is no need to form the cut part 57 shown in FIG. 5. It is noted that the same operational effects as in Embodiment 1 are exhibited also in the present embodiment.

The present disclosure is not limited to the above-mentioned embodiments and modification, and can be applied to various embodiments and modifications within the range that does not depart from the gist of the present disclosure.

The invention claimed is:

1. A compressor housing for a turbocharger configured to house a compressor impeller, the compressor housing comprising:

an intake port configured to suck in air toward the compressor impeller;

a shroud part having a shroud surface that surrounds the compressor impeller in a circumferential direction;

a diffuser part that is formed on an outer circumferential side of the compressor impeller in the circumferential direction and is configured to pressurize air discharged from the compressor impeller; and a scroll chamber configured to guide compressed air having passed through the diffuser part to outside; wherein the compressor housing is dividably composed of a plurality of pieces including a scroll piece having at least the intake port and a portion of the scroll chamber, and a shroud piece having at least a portion of the scroll chamber, a portion of the diffuser part, and the shroud part, the scroll piece and the shroud piece are assembled to each other by press-fitting a press-fitting portion of the shroud piece into a press-fitted portion of the scroll piece in an axial direction, and the scroll piece and the shroud piece are sealed to each other by annularly forming a plastic flow portion that is formed by plastic flow caused to a pressure-contacting portion and a pressure-contacted portion by pressure-contacting the pressure-contacting portion that is provided on either one of the scroll piece and the shroud piece with the pressure-contacted portion that is provided on the other one of the scroll piece and the shroud piece in the axial direction, wherein the scroll piece and the shroud piece are made from the same material.

2. The compressor housing for a turbocharger according to claim 1, wherein the scroll piece and the shroud piece each have a contact surface at a different position from positions of the pressure-contacting portion and the pressure-contacted portion, the contact surface of the scroll piece and the contact surface of the shroud piece being in contact with each other in the axial direction to thereby define the press-fitting position of the press-fitting portion.

3. The compressor housing for a turbocharger according to claim 1, further comprising a refrigerant flow path that is formed in the circumferential direction along the diffuser part, and allows a refrigerant for cooling the diffuser part to pass therethrough, wherein the refrigerant flow path is formed as an annular space that is constituted by a first refrigerant flow-path formation part of the scroll piece and a second refrigerant flow-path formation part of the shroud piece, the first refrigerant flow-path formation part and the second refrigerant flow-path formation part being formed respectively at each opposing part of the scroll piece and the shroud piece which oppose each other, an annular inner circumferential seal part is formed by press-fitting the press-fitting portion into the press-fitted portion on the inner circumferential side of the refrigerant flow path, an annular outer circumferential seal part composed of the plastic flow portion is formed on the outer circumferential side of the refrigerant flow path, and the refrigerant flow path is sealed by the inner circumferential seal part and the outer circumferential seal part.

4. The compressor housing for a turbocharger according to claim 2, further comprising a refrigerant flow path that is formed in the circumferential direction along the diffuser part, and allows a refrigerant for cooling the diffuser part to pass therethrough, wherein the refrigerant flow path is formed as an annular space that is constituted by a first refrigerant flow-path formation part of the scroll piece and a second refrigerant flow-path formation part of the shroud piece, the first refrigerant flow-path formation part and the second refrigerant flow-path formation part being formed respectively at each opposing part of the scroll piece and the shroud piece which oppose each other, an annular inner circumferential seal part is formed by press-fitting the press-fitting portion into the press-fitted portion on the inner circumferential side of the refrigerant flow path, an annular outer circumferential seal part composed of the plastic flow portion is formed on the outer circumferential side of the refrigerant flow path, and the refrigerant flow path is sealed by the inner circumferential seal part and the outer circumferential seal part.

5. A method for manufacturing the compressor housing for a turbocharger according to claim 1, the method comprising:

molding the scroll piece and the shroud piece by die-casting;

machining the scroll piece and the shroud piece to form either one of the pressure-contacting portion and the pressure-contacted portion and the other one of the pressure-contacting portion and the pressure-contacted portion respectively; and assembling the scroll piece and the shroud piece to each other by press-fitting the press-fitting portion into the press-fitted portion while pressure-contacting the pressure-contacting portion with the pressure-contacted portion in the axial direction to cause plastic flow thereto and form the plastic flow portion.

6. A method for manufacturing the compressor housing for a turbocharger according to claim 2, the method comprising:

molding the scroll piece and the shroud piece by die-casting;

machining the scroll piece and the shroud piece to form either one of the pressure-contacting portion and the pressure-contacted portion and the other one of the pres sure-contacting portion and the pressure-contacted portion respectively; and assembling the scroll piece and the shroud piece to each other by press-fitting the press-fitting portion into the press-fitted portion while pressure-contacting the pressure-contacting portion with the pressure-contacted portion in the axial direction to cause plastic flow thereto and form the plastic flow portion.

7. A method for manufacturing the compressor housing for a turbocharger according to claim 3, the method comprising:

molding the scroll piece and the shroud piece by die-casting;

machining the scroll piece and the shroud piece to form either one of the pressure-contacting portion and the pressure-contacted portion and the other one of the pres sure-contacting portion and the pressure-contacted portion respectively; and assembling the scroll piece and the shroud piece to each other by press-fitting the press-fitting portion into the press-fitted portion while pressure-contacting the pressure-contacting portion with the pressure-contacted portion in the axial direction to cause plastic flow thereto and form the plastic flow portion.

8. A method for manufacturing the compressor housing for a turbocharger according to claim 4, the method comprising:

molding the scroll piece and the shroud piece by die-casting;

machining the scroll piece and the shroud piece to form either one of the pressure-contacting portion and the pressure-contacted portion and the other one of the pressure-contacting portion and the pressure-contacted portion respectively; and assembling the scroll piece and the shroud piece to each other by press-fitting the press-fitting portion into the press-fitted portion while pressure-contacting the pressure-contacting portion with the pressure-contacted portion in the axial direction to cause plastic flow thereto and form the plastic flow portion.

9. The method according to claim 5, wherein in the machining, the pressure-contacting portion is formed on a ridgeline portion that projects convexly to the pressure-contacted portion.

10. The method according to claim 6, wherein in the machining, the pressure-contacting portion is formed on a ridgeline portion that projects convexly to the pressure-contacted portion.

11. The method according to claim 7, wherein in the machining, the pressure-contacting portion is formed on a ridgeline portion that projects convexly to the pressure-contacted portion.

12. The method according to claim 8, wherein in the machining, the pressure-contacting portion is formed on a ridgeline portion that projects convexly to the pressure-contacted portion.

* * * * *